US009429896B2

(12) United States Patent
Yamamoto

(10) Patent No.: US 9,429,896 B2
(45) Date of Patent: Aug. 30, 2016

(54) COVER MOVEMENT MECHANISM, AND IMAGE FORMING APPARATUS PROVIDED WITH THE COVER MOVEMENT MECHANISM

(71) Applicant: BROTHER KOGYO KABUSHIKI KAISHA, Nagoya-shi, Aichi-ken (JP)

(72) Inventor: Koyo Yamamoto, Nisshin (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 4 days.

(21) Appl. No.: 14/661,551

(22) Filed: Mar. 18, 2015

(65) Prior Publication Data

US 2015/0268623 A1 Sep. 24, 2015

(30) Foreign Application Priority Data

Mar. 19, 2014 (JP) ..... 2014-056576

(51) Int. Cl.
*G03G 21/16* (2006.01)

(52) U.S. Cl.
CPC ..... *G03G 21/1633* (2013.01); *G03G 21/1647* (2013.01)

(58) Field of Classification Search
CPC ..... G03G 15/6552; G03G 21/1633; G03G 21/1638; E05D 7/1044; E05D 7/105
See application file for complete search history.

(56) References Cited

U.S. PATENT DOCUMENTS

2011/0013931 A1 1/2011 Shikata

FOREIGN PATENT DOCUMENTS

| | | | |
|---|---|---|---|
| JP | 10-25948 | A | 1/1998 |
| JP | 2001-130095 | A | 5/2001 |
| JP | 2004-306521 | A | 11/2004 |
| JP | 2006-203777 | A | 8/2006 |
| JP | 2007-203485 | A | 8/2007 |
| JP | 2011-0022500 | A | 2/2011 |

*Primary Examiner* — Erika J Villaluna
(74) *Attorney, Agent, or Firm* — Merchant & Gould P.C.

(57) ABSTRACT

A cover movement mechanism has a cover, a base part, a holding part configured to contact the cover in a first opened state in which the cover is rotated to open by a first angle with respect to a closed state, thereby holding the cover in the first opened state, two shafts having a common axis and provided to one of the cover and the base part, two bearings configured to receive the two shafts and provided to other one of the cover and the base part, and a releasing mechanism configured to allow at least one of the two shafts to be released from corresponding one of the two bearings when the cover is in a second state in which the cover is rotated to open by a second angle that is smaller than the first angle and an opposing force preventing a rotation of cover acts on the cover.

13 Claims, 10 Drawing Sheets

COVER MOVEMENT MECHANISM, AND IMAGE FORMING APPARATUS PROVIDED WITH THE COVER MOVEMENT MECHANISM

This application claims priority under 35 U.S.C. §119 from Japanese Patent Application No. 2014-056576 filed on Mar. 19, 2014. The entire subject matter of the application is incorporated herein by reference.

BACKGROUND

1. Technical Field

The present disclosures relate to a cover movement mechanism and an image forming apparatus provided with the cover movement mechanism. More particularly, the present disclosures relate to the cover movement mechanism with which a damage of a cover provided to the image forming apparatus or the like can be avoided.

2. Related Art

Conventionally, image forming apparatuses provided with openable covers have been known. In such an image forming apparatus, in order to prevent the cover from being damaged when a user attempts to open the same beyond an openable range thereof may be provided. One example of a conventional cover movement mechanism is configured such that a rotational shaft, which rotationally supports the cover, is provide. The rotation shaft is held by bearings, and shaft cover pieces which press-holds the rotational shaft in the respective bearings are provided. When the user attempts to open the cover beyond the openable range, the shaft covers elastically deform and allow the shaft to be released from the bearings. With such a configuration, in an exemplary conventional art, the damage of the cover can be prevented.

SUMMARY

Even in the above-described configuration, if the user attempts to open the cover with a finger, a part of cloths or the like being sandwiched between a base part, to which the cover is attached, and the cover (i.e., with the finger or the like being nipped in the opening formed between the base part and the cover), an unexpected force may be applied to the cover, which may result in a damage of the cover.

According to aspects of the disclosure, there is provided a cover movement mechanism, which is provided with a cover configured to rotate, a base part to which the cover is rotatably attached, a holding part configured to contact the cover when the cover is in a first opened state in which the cover is rotated to open by a first angle with respect to a closed state of the cover, thereby holding the cover in the first opened state, two shafts having a common axis and provided to one of the cover and the base part, two bearings configured to receive the two shafts and provided to other one of the cover and the base part, and a releasing mechanism configured to allow at least one of the two shafts to be released from corresponding one of the two bearings when the cover is in a second state in which the cover is rotated to open by a second angle that is smaller than the first angle and an opposing force preventing a rotation of cover acts on the cover.

According to aspects of the disclosures, there is also provided an image forming apparatus, provided with a housing, a printing unit configured to form an image on a sheet, a sheet discharging unit configured to discharge the sheet on which the image is printed, and a cover movement mechanism. The cover movement mechanism includes a cover configured to rotate, a base part to which the cover is rotatably attached, a holding part configured to contact the cover when the cover is in a first opened state in which the cover is rotated to open by a first angle with respect to a closed state of the cover, thereby holding the cover in the first opened state, two shafts having a common axis and provided to one of the cover and the base part, two bearings configured to receive the two shafts and provided to other one of the cover and the base part, and a releasing mechanism configured to allow at least one of the two shafts to be released from corresponding one of the two bearings when the cover is in a second state in which the cover is rotated to open by a second angle that is smaller than the first angle and an opposing force preventing a rotation of cover acts on the cover. The cover in the first opened state serves as a printed sheet discharge tray configured to receive the sheet discharged by the sheet discharging unit.

BRIEF DESCRIPTION OF THE ACCOMPANYING DRAWINGS

DETAILED DESCRIPTION OF ILLUSTRATIVE EMBODIMENTS

Figure 1:
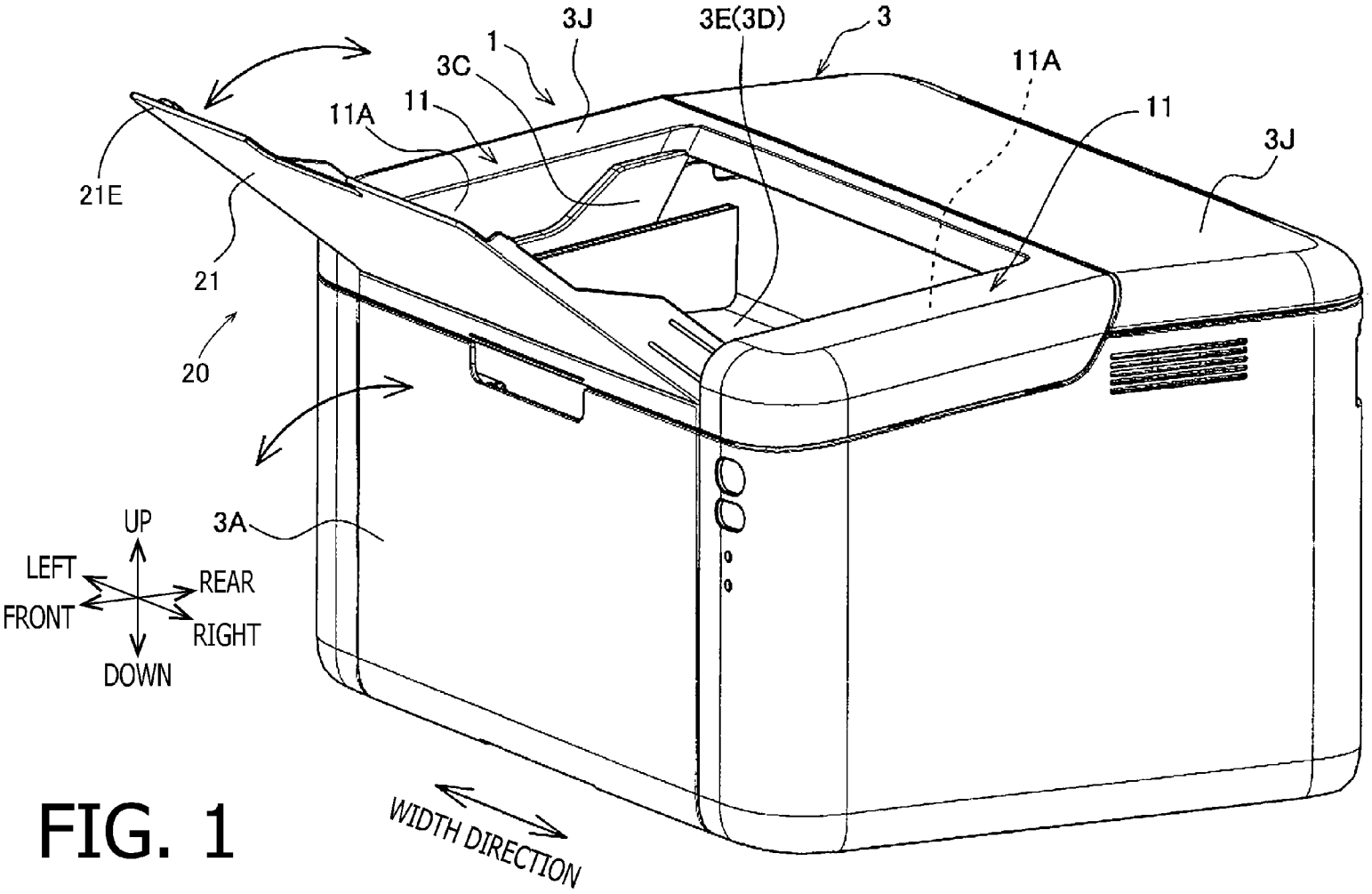
FIG. 1 is a perspective view of a printer according to aspects of an illustrative embodiment.

Hereinafter, referring to the accompanying drawings, a printer according to aspects of illustrative embodiments will be described. In the following description, a printer 1 is described in detail as an example of an illustrative embodiment. According to the illustrative embodiment, the printer 1 is a monochromatic laser printer employing an electrophotographic image forming method. As shown in FIG. 1, the printer 1 has a housing 3 which accommodates a printing unit 5. On a front surface of the housing 3, a first cover 3A is attached so as to be rotatable about an axis extending in a width direction. It is noted that directions with respect to the printer 1 are indicated in drawings, and description will be made referring to the directions as indicated. FIG. 1 shows a state where the first cover 3A is closed. It is noted that the printer 1 needs not be limited to the monochromatic laser printer, and could be any other printing apparatus, or an image forming apparatus such as a color laser printer, an inkjet printer, an LED (light emitting diode) printer, or the like.

On an upper part of the printer 1, a cover movement mechanism 20 is provided. The cover movement mechanism 20 includes a second cover 21. FIG. 1 shows a state where the second cover 21 is opened.

As shown in FIG. 1, the second cover 21 is configured to cover an upper part of the cover movement mechanism 20. A rear end part 21E of the cover 21 is configured to move toward a front side of the cover movement mechanism in accordance with a rotation of the second cover 21.

Figure 2:
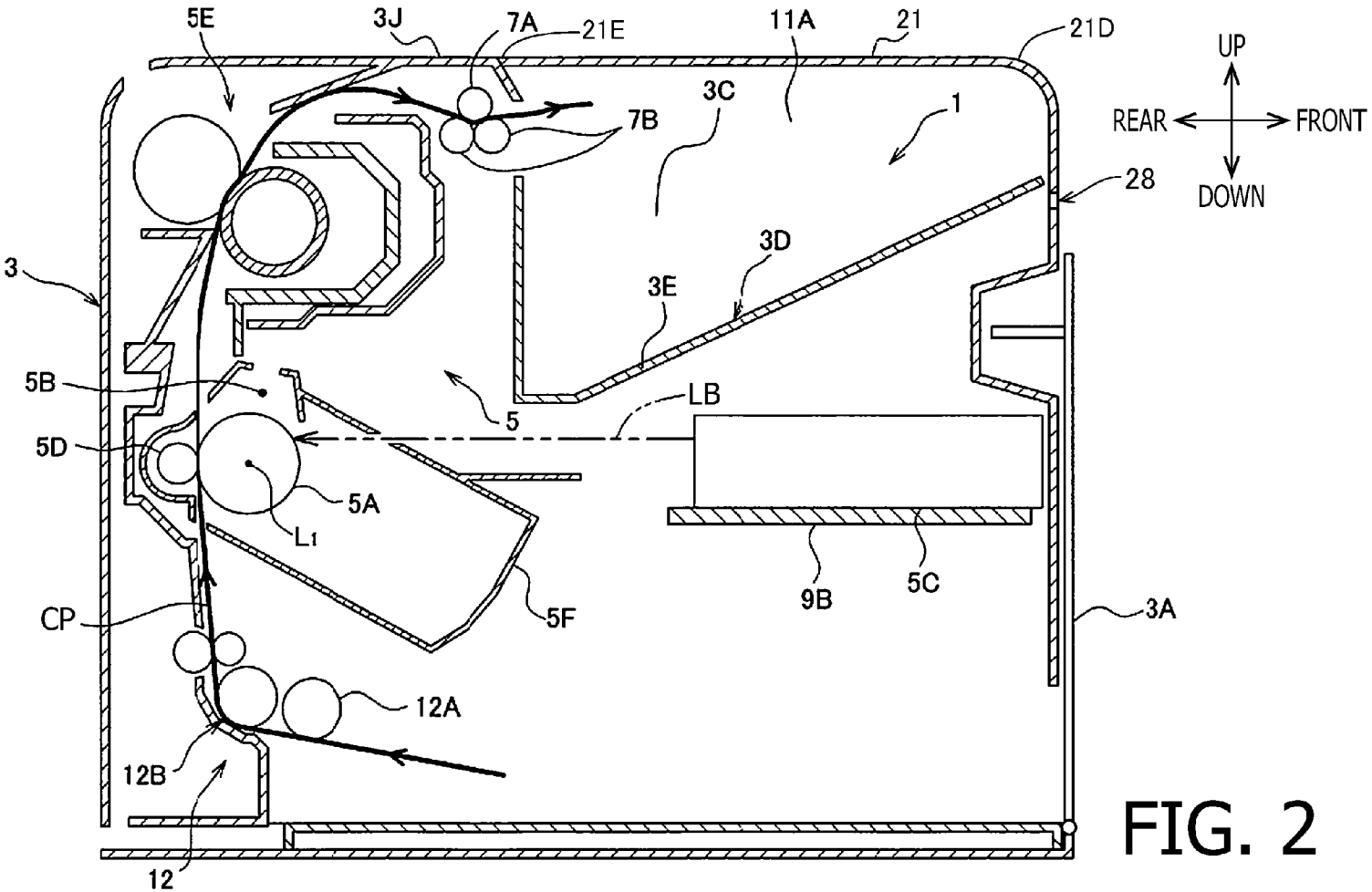
FIG. 2 is a cross-sectional side view of the printer schematically showing main components of the printer according to aspects of the illustrative embodiment.

The second cover 21 is rotatable between a position where the second cover 21 closes the upper side of a discharge part 3C (i.e., in a closed state) and a position where the upper side of the discharge part 3C is exposed (i.e., in an open state). The discharge part 3C is a space arranged on an upper part of the housing 3. In the discharge part 3C, as shown in FIG. 2, a discharged sheet tray 3D configured to receive the sheets on which images have been printed and discharged from the housing 3 is provided.

When an image formation is executed, the user may rotate the first cover 3A and the second cover 21 frontward to open the same, and place a sheet on the opened first cover 3A. When the image formation process is started, the sheet placed on the first cover 3A is fed toward the printing unit 5 inside the housing 3, and an image is formed thereon by the printing unit 5. After the image is formed, the sheet is further conveyed and stacked on a discharge surface 3E, which is an upper surface of the discharged sheet tray 3D and on the second cover 21. That is, when the second cover 21 is in the open state, the surface of the second cover 21 is used as a part of the discharged sheet tray.

The printing unit 5 is configured to form (i.e., print) an image on a sheet such as a printing sheet. According to the illustrative embodiment, the printing unit 5 is an electrophotographic image forming unit, and includes a photosensitive drum 5A, a charging unit 5B, an exposing unit 5C, a transferring unit 5D and a fixing unit 5E. The discharge surface 3E is arranged on an upper side with respect to a rotational axis L1 of the photosensitive drum 5A.

The charging unit 5B charges the circumferential surface of the photosensitive drum 5A. The exposing unit 5C exposes the charged surface of the photosensitive drum 5A to form an electrostatic latent image thereon. Then, the developing agent (e.g., toner) is applied on the circumferential surface of the photosensitive drum 5A, and the developing agent is attracted by the electrostatic latent image, thereby a developed image is formed. The transferring unit transfers the developed image (e.g., a toner image) on the sheet.

The fixing unit 5E fixes the developing agent transferred on the sheet thereon. The sheet discharged from the developing unit 5E is discharged toward the discharge sheet tray 3D by a discharging roller 7A as the sheet on which an image has been formed. A pair of pressing rollers 7B are provided to urge the sheet toward the discharging roller 7A. With this configuration, the sheet is discharged while a curling tendency of the sheet is corrected.

A process casing 5F accommodating the photosensitive drum 5A and the exposing unit 5C, and the printing unit 5 including the fixing unit 5E and the like are assembled to a main body of the printer 20. The main body includes components which are not normally detached/attached or decomposed by the user in normal use, and includes the pair of frames 9 and the housing 3 shown in FIG. 3.

The pair of frames 9 are plate-like components arranged on both sides of the printing unit 6 such as the process casing 5F. According to the illustrative embodiment, the pair of frames 9 are made of resin, and the printing unit 5 such as the process casing 5F is supported by the pair of frames 9.

The exposing unit 5C is held by the plate 9B shown in FIG. 2, and supported by the frames 9. The plate 9B is a metal plate member arranged below the discharged sheet tray 3D, and extends to be bridged between the pair of frames 9 such that both ends, in the extending direction, of the plate 9B are fixed to the pair of frames, respectively.

Figure 3:
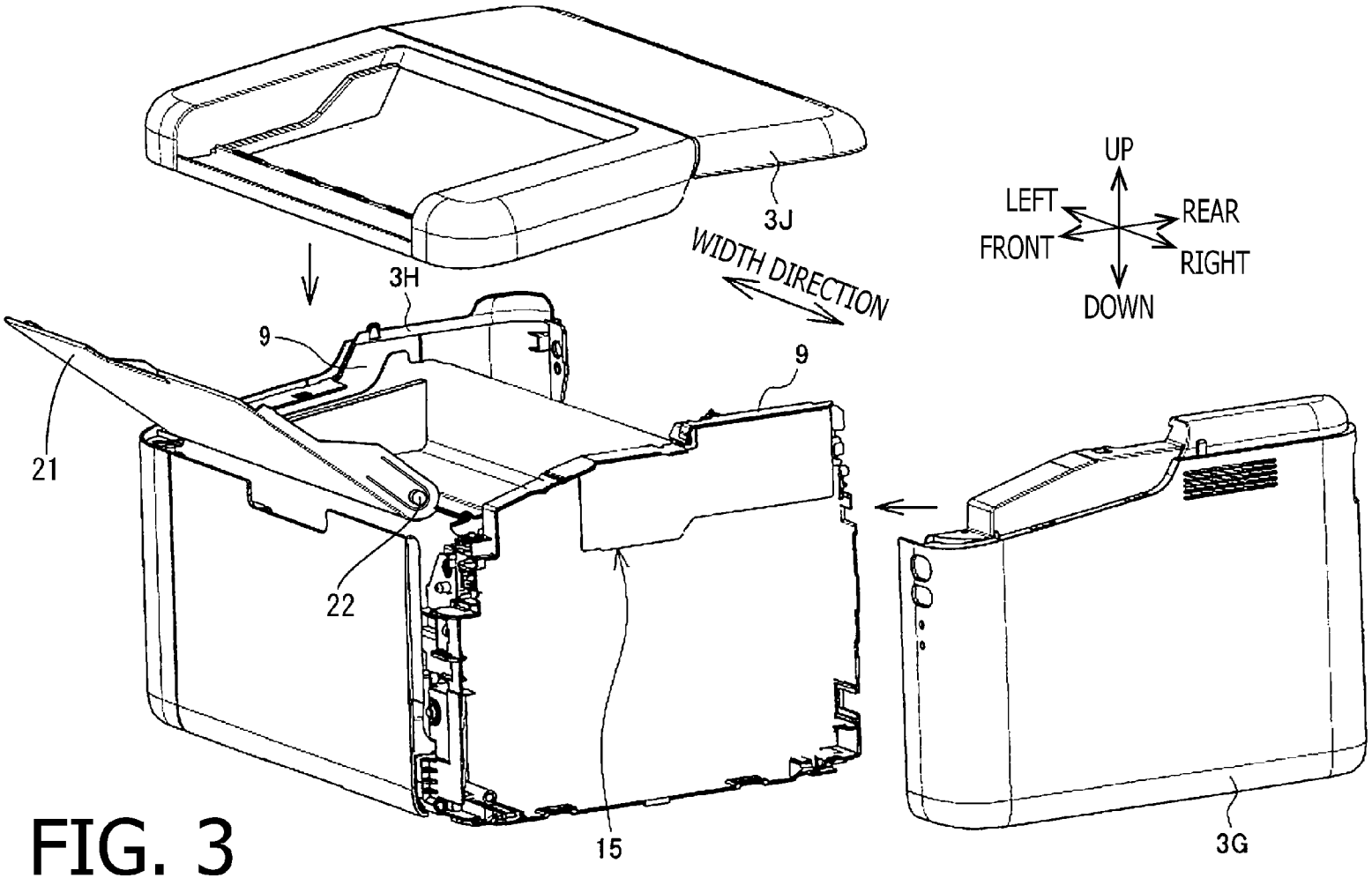
FIG. 3 is an exploded perspective view of the printer according to aspects of an illustrative embodiment.

As shown in FIG. 3, the housing 3 is configured such that the pair of frames 9 are covered with exterior covers 3G-3J and the like from outside. The exterior covers 3G and 3H are side covers which cover the pair of frames 9 from a width direction. It is noted that the width direction is as indicated in FIG. 1, a direction along which the pair of frames 9 face each other. According to the illustrative embodiment, the width direction coincides with the right-and-left direction. The exterior cover 3J is a top cover that covers the pair of frames 9 from the above.

A feeder mechanism 12 is shown in FIG. 12. The feeder mechanism 12 is configured to covey the sheet placed on the first cover 3A toward the printing unit 5. The feeder mechanism 12 has a pickup roller 12A and a separation unit 12B.

Among the pickup roller 12A, and the components configuring the separation unit 12B, and printing unit 5, rotating components such as the photosensitive drum 5A receive a driving force from a driving source (not shown) such as an electrical motor.

The pickup roller 12A is configured to contact a sheet on one side, in a stacking direction, of the plurality of sheets which are stacked, and rotate. If a plurality of sheets are fed by the pickup roller 12A, the separation unit 12B functions to separate the plurality of sheets and feed the same one by one toward the printing unit 5.

Further, as shown in FIG. 1, on both sides, in the width direction, of the discharge sheet tray 3D, a pair of bank parts 11 are formed, respectively. Each of the pair of bank parts 11 as a wall 11A. Each wall 11A is configured to extend uprightly from the discharge surface 3E and faces the discharge part 3C. The walls 11A, or the pair of bank parts 11 functions to prevent the sheets placed on the discharge surface 3E from hanging out of the discharge sheet tray 3D.

An outer surface of each of the bank parts 11 including the wall 11A is composed of the exterior cover 3J. The upper end portions of the pair of frames 9 are covered with the exterior cover 3J and located inside the bank parts 11, respectively.

A controller substrate 15 is a substrate on which a controller unit configured to control operations of the printing unit 5 and the driving source 8 and the like is provided. The controller substrate 15 is attached to a plate surface 9A which is a surface of one of the pair of frames (e.g., the right side frame) 9 opposite to a surface facing the printing unit 5, that is a surface 9A facing the exterior cover 3G.

Next, refereeing to FIGS. 4-8, the cover movement mechanism 20 will be described. FIGS. 7A and 7B are partial cross-sections views taken along line A-A of FIG. 8B.

Figure 4:
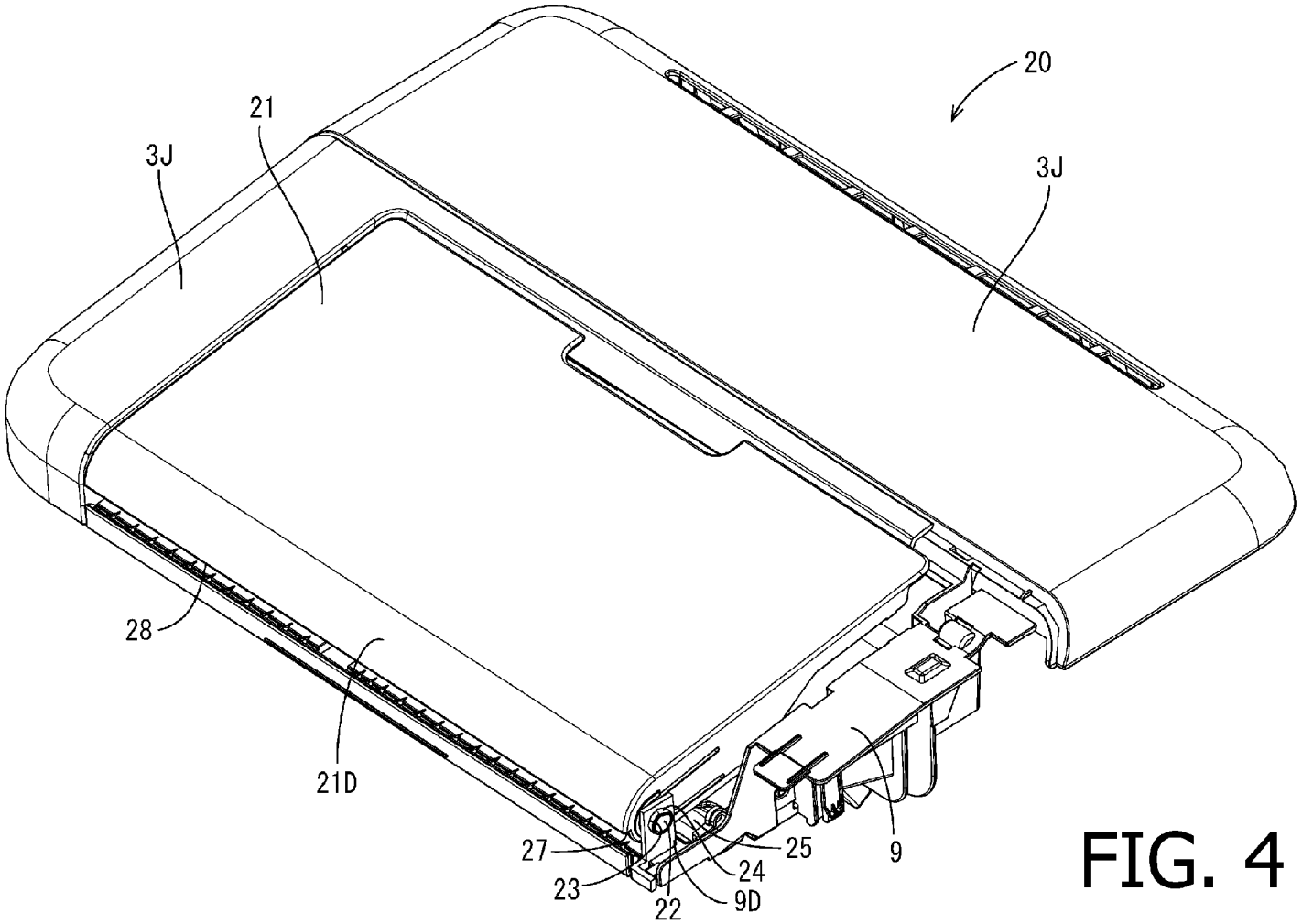
FIG. 4 is a perspective view of a cover movement mechanism according to aspects of an illustrative embodiment.

The cover movement mechanism 20 has, as shown in FIG. 4, the second cover 21, the frames 9, cover supporting frames 9D and cover holding parts 25.

Figure 5A:
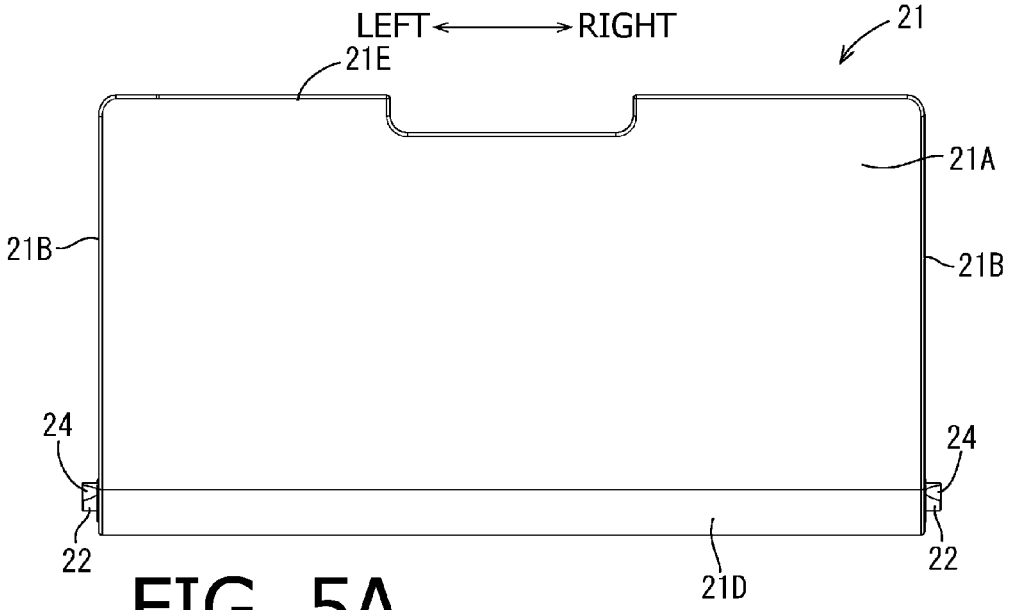
FIG. 5A is a plan view of a second cover of the printer according to aspects of an illustrative embodiment.
Figure 5B:
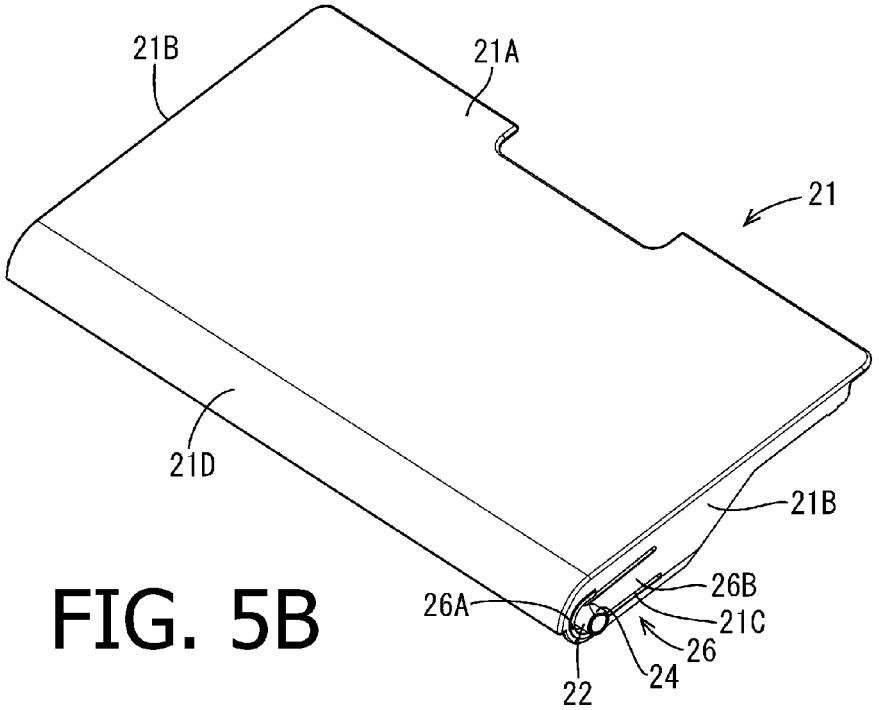
FIG. 5B is a perspective view of the second cover according to aspects of an illustrative embodiment.
Figure 6:
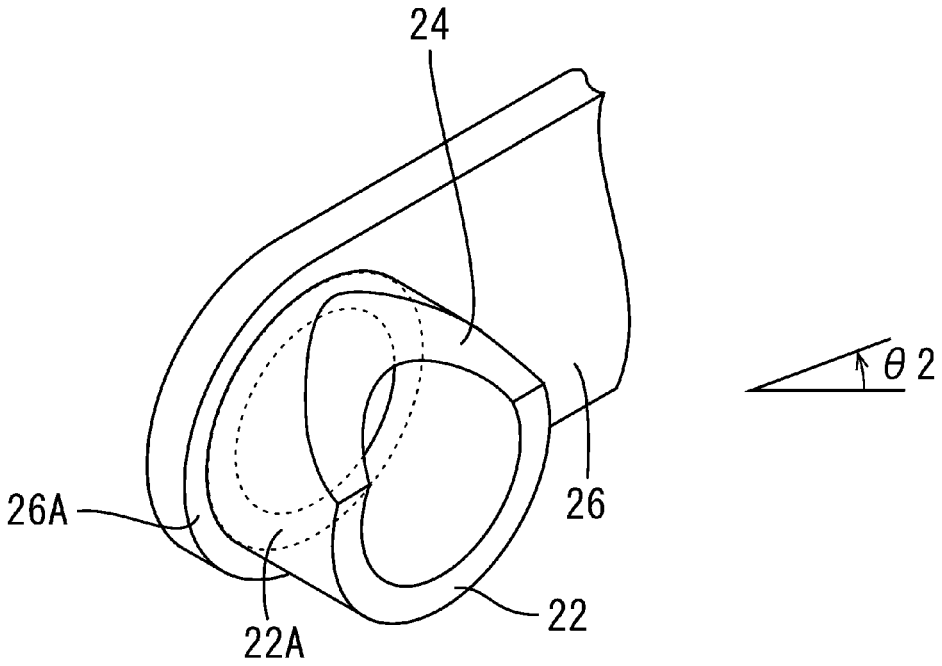
FIG. 6 is a perspective view of a shaft schematically showing a shape thereof according to aspects of an illustrative embodiment.
Figure 7A:
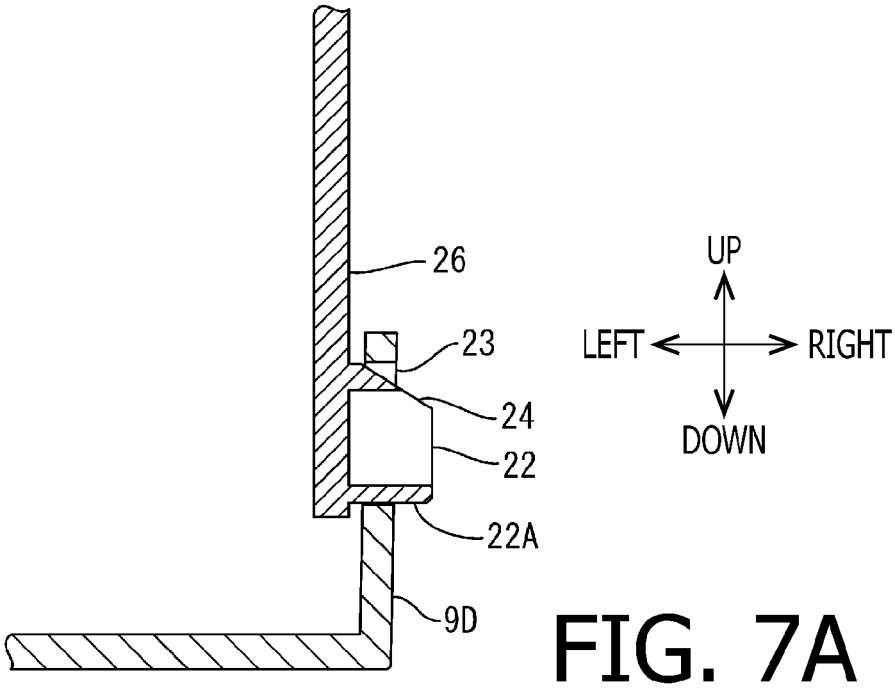
FIG. 7A is a cross-sectional view of a second cover attachment part according to aspects of an illustrative embodiment.
Figure 7B:
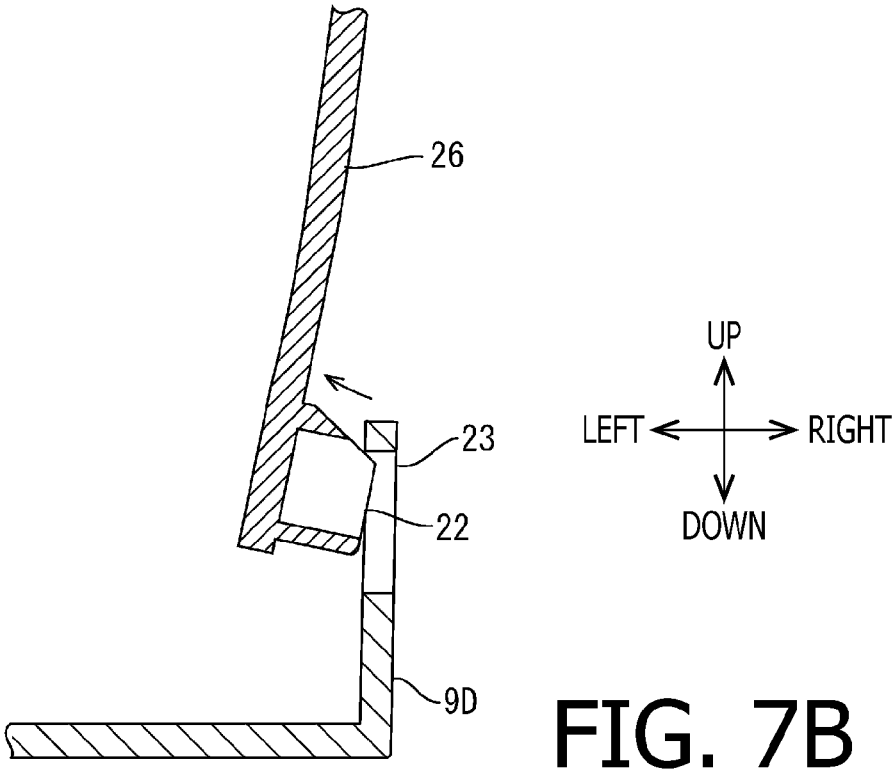
FIG. 7B is a cross-sectional view of the second cover attachment part when the second cover is to be detached according to aspects of an illustrative embodiment.

The second cover 21 is formed to have a rectangular shape, when viewed from the above, as shown in FIGS. 5 and 6, and has cover plate 21A, and side plates 21B formed on both sides of the cover plate 21A.

Each side plate 21B has, as shown in FIG. 5B, a plate spring part 26 which is defined by forming a slit 21C. The plate spring part 26 has a movable end 26A, which is separated from the side plate 21B with the slit 21C, and a fixed end connected to the side plate.

On a front end part 21D, which corresponds to a longer side of the second cover 21, a contacting part 27 configured to contact the cover holding part 25 (described later) is formed. The front end part 21D defines an opened part 28 in association with the frames 9 when the second cover 21 is closed (see FIG. 8A). A width along a narrower side (i.e., in the up-and-down direction in f of the opened part 28 decreases as the second cover 21 is rotated (see FIGS. 8A and 8B).

On each plate spring part 26, a shaft 22 is provided. That is, the shaft 22 is provided to the front end part 21D of the second cover 21, at a position on a front side of the cover movement mechanism 20. According to the illustrative embodiment, each shaft 22 is protruded outward from the side plates 21B of the second cover 21. In other words, the shaft 22 is provided at a tip end portion on the movable end 26A side of the plate spring part 26, and protrudes outward, in an axial direction, from the side plate 21B of the second cover 21 (see FIGS. 5A and 5B).

It is noted that the axial direction is a right-and-left direction indicated by an arrow in FIG. 5A. An expression "protrudes outward, in the axial direction, from the side plate 21B of the second cover 21" means to protrude rightward in FIG. 5A with respect to the right one of the side plates 21B, while means to protrude leftward in FIG. 5A with respect to the left one of the side plates 21B.

Each shaft 22 has a hollow cylinder shape as shown in FIG. 6, and a truncated part 24 having a tapered shape, is formed on a part of its outer circumferential surface. When the second cover 21 is in a second open state, in which the second cover 21 is opened at a second angle θ2 (e.g., 30 degrees) which is smaller than a first angle θ1 (e.g., 150 degrees), if an opposing force that obstructs the rotation of the second cover 21 is applied to the second cover, the truncated parts 24 serve such that at least one of the two shafts 22 is released from the bearing 23 (see FIGS. 7A and 7B). It is noted that FIG. 6 shows the shaft 22 when second cover 21 is in the second open state as shown in FIG. 8B.

As described above, according to the illustrative embodiment, the shafts 22 are formed to protrude outward from side pates 21B of the second cover 21, respectively. Accordingly, in comparison with a case where the truncated part 24 is formed on the outer circumferential surface of a shaft protruding inward from the side plate 21B, it is relatively easy to form the truncated part 24.

It is noted that, according to the illustrative embodiment, the plate spring part 26 is defined by forming the slit 21C on each side plate 21B and the shaft 22 is formed on the plate spring part 26. However, aspects of the disclosures need not be limited to such a configuration. For example, the shaft 22 may be formed on each side plate 21B. In such case, it is preferable that each side plate 21B is formed of elastic resin. Further, the truncated part 24 may be formed on only one of the two shafts 22. Furthermore, the shape of the truncated part 24 may not be limited to the tapered shape.

The cover supporting frame 9D is formed as a part of the frame 9, as shown in FIG. 4, and formed to be a plate-like member extending upward. Each of the cover supporting frame 9D is formed with the bearing 23, as shown in FIGS. 4 and 7A. As the shafts 22 engage with the bearings 23, respectively, the second cover 21 is coupled to the cover supporting frame 9D.

Figure 8A:
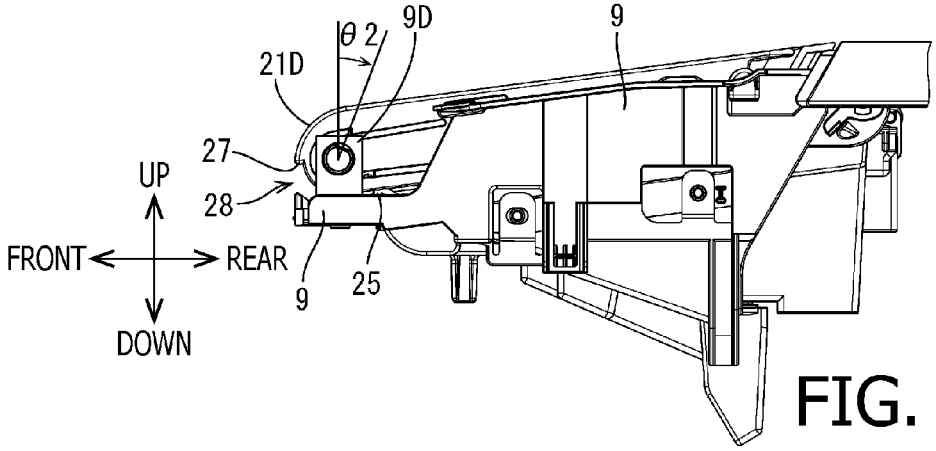
FIG. 8A is a side view showing a state where the second cover is closed according to aspects of an illustrative embodiment.
Figure 8B:
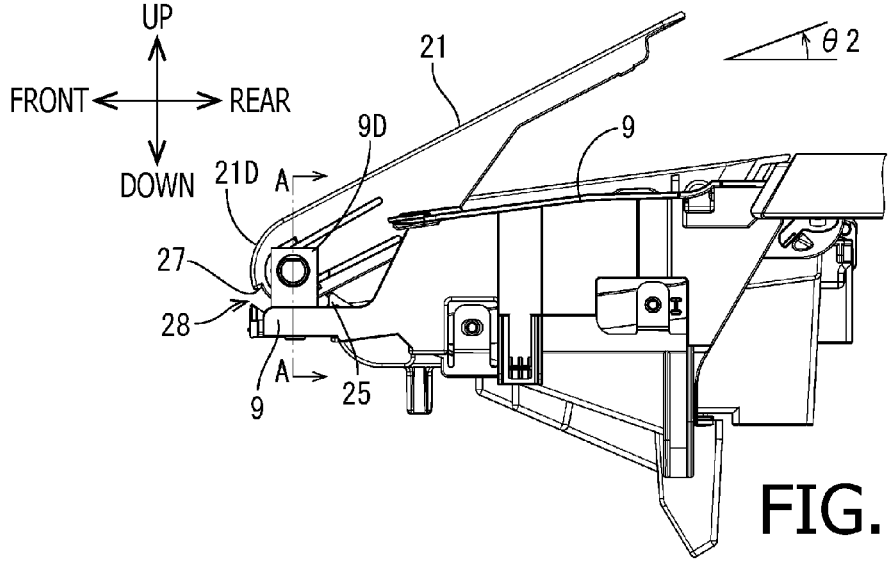
FIG. 8B is a side view showing a second open state of the second cover according to aspects of an illustrative embodiment.

The cover holding parts 25 hold the second cover 21 to be in the first opened state with respect to the main body, as the cover holding parts 25 contact the contacting parts 27 of the second cover 21 when the second cover 21 is in the first opened state (see FIG. 8C) which is a position the second cover 21 has rotated by the first angle θ1 with respect to the position when the second cover is in the closed state (see FIG. 8A).

Next, referring to FIGS. 8A-8C, operations of the cover movement mechanism 20 will be described.

When the second cover 21 is in the closed state, as shown in FIG. 8A, the truncated part 24 is oriented in a direction rotated clockwise by the second angle θ2 with respect to a vertical direction, or the up-and-down direction in FIG. 3A.

As shown in FIG. 8B, in the second opened state (see FIG. 8B) in which the second cover 21 is opened by the second angle θ2 (e.g., 30 degrees), the truncated part 24 is oriented in the vertical directions, or the up direction in FIG. 8B (see FIGS. 6 and 7A). In this state, when a finger or the like is nipped in the opening part 28, the opposing force to obstruct the rotation of the second cover 21 from the second opened state to the first opened state works on the second cover 21. In such a case, the opposing force works upward in FIG. 8B, thereby the opposing force working such that the at least one of the shaft 22 is released from the bearing 23 as the truncated part 24 is oriented upward.

When the finger or the like is nipped in the opening part 28, a downward component of the rotational force to rotate the second cover 21 is applied to the finger or the like. Then, from the finger or the like, a reactive force (i.e., opposing force) directed upward is generated. As the contacting part 27, which is the front part of the second cover 21, receives the reactive force, an upward opposing force works on the shafts 22. As the upward opposing force is applied, the truncated part 24 receives a downward opposing force (see FIG. 7B). Since the truncated part 24 is formed to have the tapered shape, the downward opposing force also works as an inward component (i.e., leftward force in FIG. 7B). Accordingly, the plate spring part 26 receives the force and elastically deforms, thereby at least one of the two shafts 22 is released from the bearing 23 (see FIG. 7B).

Although one of the two shafts 22 is shown in FIG. 7B, the other shaft 22 may be release from the bearing 23 in a similar manner. Which one, or whether one or two of the shafts 22 is to be removed depends on a position at which the finger or the like is nipped in the opening part 28 and/or amplitude of the opposing force.

Figure 8C:
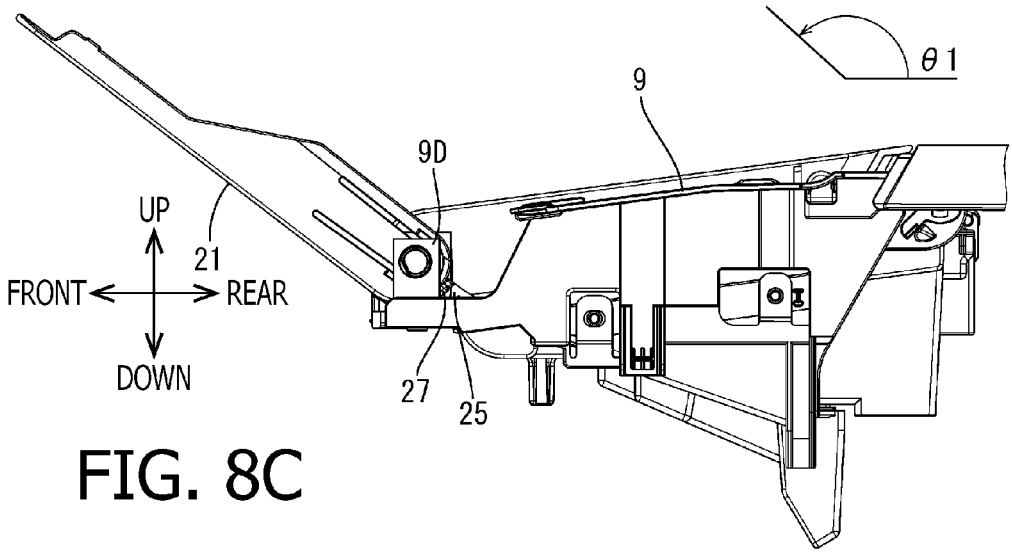
FIG. 8C is a side view showing a first open state of the second cover according to aspects of an illustrative embodiment.

As shown in FIGS. 8A-8C, when the second cover 21 is attached to the cover supporting frames 9D, the outer surfaces (i.e., the circumferential surfaces) 22A of the shafts 22 substantially contact the inner circumferential surface of the bearing 23 except for the truncated parts 24. With this configuration, when the second cover 21 is in the second opened state, in which the second cover 21 is opened by the second angle θ2, the user can detach the second cover 21. In other state, the user can open/close the second cover 21, and the second cover 21 will not be detached. That is, the shape of the truncated parts 24 are utilized effectively.

For example, when the second cover 21 is opened, when a finger is nipped in the opening part 28, the reactive force is applied to the shafts 22, and the truncated parts 24. Then, because of the configuration of the truncated parts 24 formed on the shafts 22 of the second cover 21, the shaft 22 is detached from the bearing 23, thereby the second cover 21 being detached from the bearing 23 and the second cover 21 being detached from the cover supporting frame 9D. With the above configuration, the damage of the second cover 21 when the second cover 21 is opened/closed can be suppressed.

Aspects of the present disclosures need not be limited to the above-described illustrative embodiment, and can be modified in various ways as described below.

Figure 9:
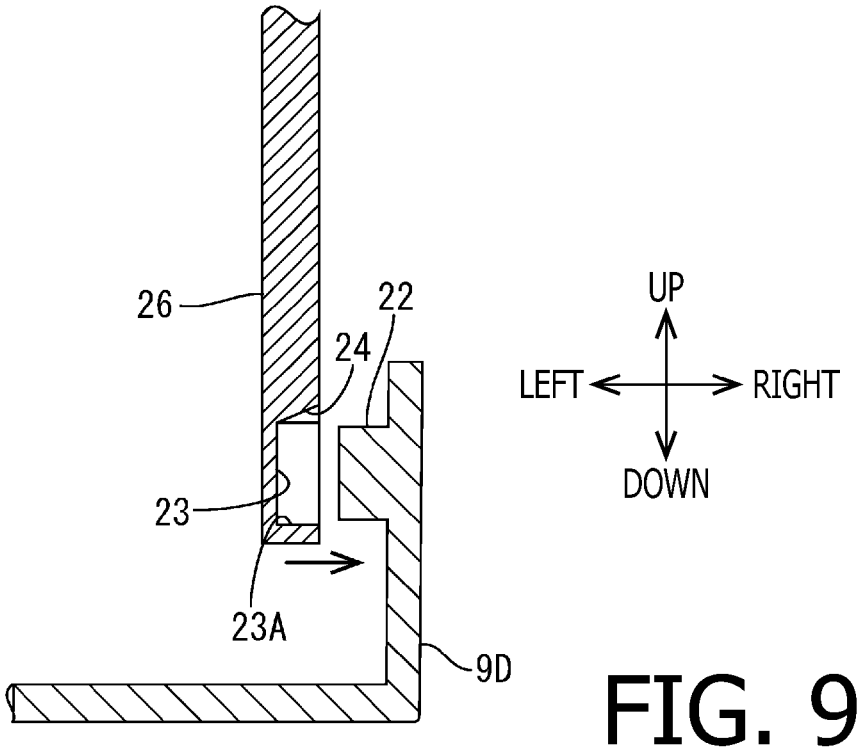
FIG. 9 is a cross-sectional view of a second cover attachment part according to aspects of another illustrative embodiment.

In the illustrative embodiment described above, the two shafts 22 are provided to the second cover 21 and the bearings 23 are provided to the cover supporting frame 9D. Further, the truncated parts 24 are formed on the outer circumferential surfaces 22A of the shafts 22, respectively. Such a configuration may be modified such that, as shown in FIG. 9, two shafts 22 are provided to the cover supporting frame 9D, the bearings 23 are provided to the second cover 21, and the truncated parts 24 may be provided in the inner circumferential surfaces 23A of the bearings 23, respectively. According to such a modification, when the finger or the like is nipped in the opening part 28, because of the truncated parts 24, the second cover 21 can be detached by the opposing force.

Figure 10:
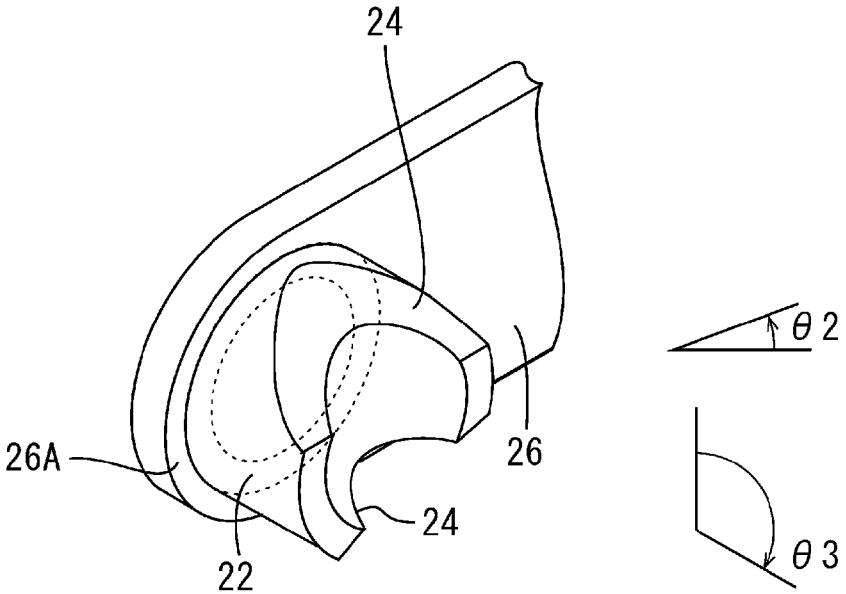
FIG. 10 is a perspective view of a shape of a shaft of the second cover according to aspects of another illustrative embodiment.

In the illustrative embodiment and modification described above, the truncated parts 24 are formed, on the outer circumferential surfaces of the shafts 22 or the inner circumferential surface of the bearing 23, at positions corresponding to the first opened state of the second cover 21. However, the configuration need not be limited to such ones. As shown in FIG. 10, the truncated parts 24 may be provided, on the outer circumferential surfaces of the shafts 22 or the inner circumferential surfaces of the bearings 23, at positions corresponding to both the first opened state of the second cover 21 and the second opened state of the second cover 21. In such case, by forming the truncated part 24 at a position corresponding to a position exceeding the movable range of the second cover 21, it becomes possible to detach the second cover 21 even when the user attempts to open the second cover in excess of the movable range of the second cover 21 (e.g., in excess of the moveable range of 150 degrees). If the truncated part 24 is formed on the outer circumferential surface of the shaft 22, when the first angle θ1 is 150 degrees, for example, and the second angle θ2 is 30 degrees, for example, the positions corresponding to the second opened state of the second cover 21 is, as shown in FIG. 10, a position apart from the position corresponding to the first opened state by the angle of θ3 (120 degrees) rightward.

In the above-described embodiment and modifications, the truncated parts 24 are formed so that, when the opposing force acts in the vertical direction when the second cover 21 is in the second opened state, the second cover 21 is detached from the cover supporting frame 9D. The aspects of the disclosures need not be limited to such a configuration, and the truncated parts 24 may be formed at directions corresponding to the direction where the opposing force may act.

Figure 11A:
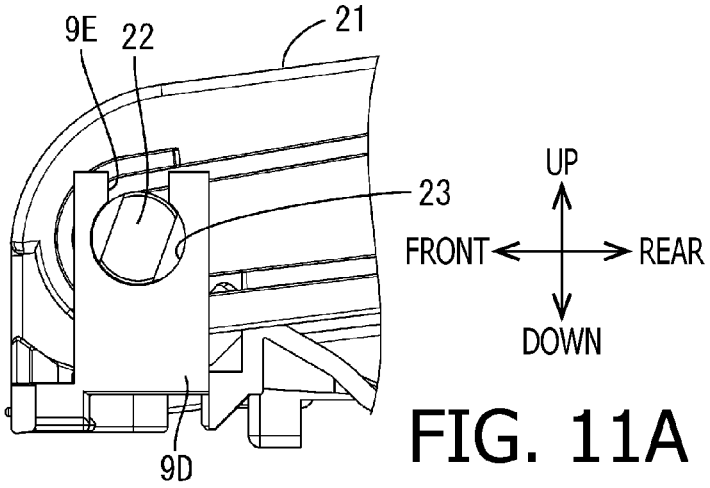
FIG. 11A is a side view showing a state where the second cover is closed according to aspects of the other illustrative embodiment.

In the above-described illustrative embodiment and modifications, a releasing part is realized by forming the truncated parts 24. The aspects of the disclosures need not be limited to such a configuration. For example, as shown in FIGS. 11A-11C, the releasing part may be realized by an opening 9E formed on an upper part of the cover supporting frame 9D, the opening 9E, and the shaft 22 formed to be released from the cover supporting frame 9D via the opening 9E.

Figure 11B:
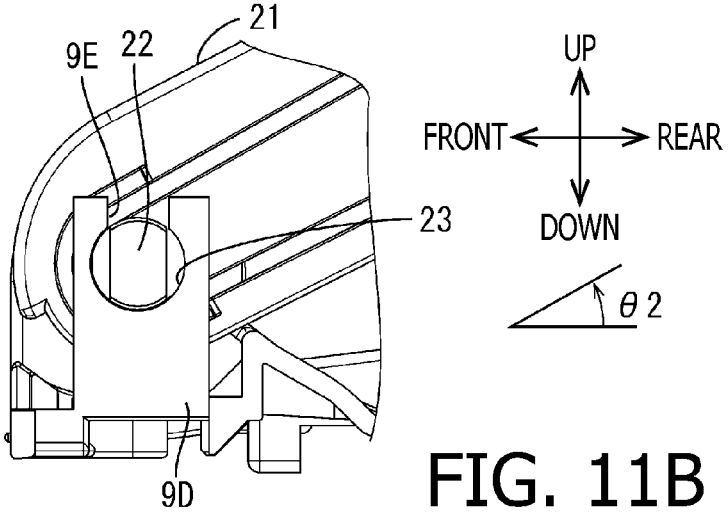
FIG. 11B is a side view showing a second open state of the second cover according to aspects of the other illustrative embodiment.
Figure 11C:
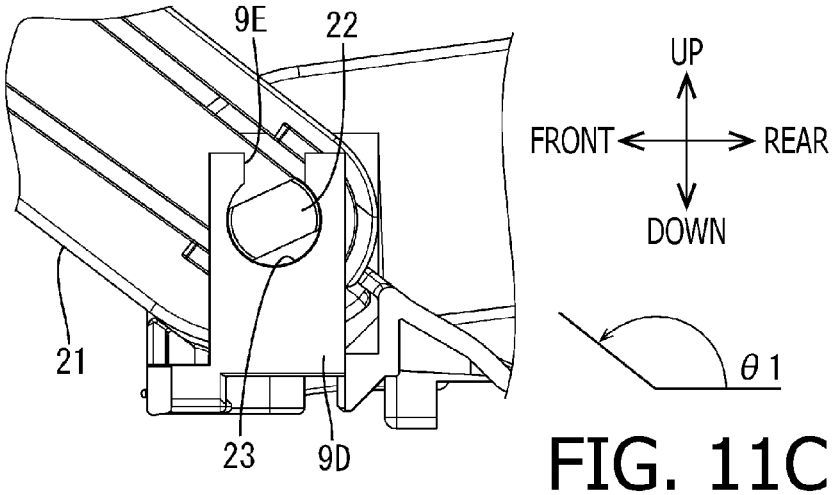
FIG. 11C is a side view showing a first open state of the second cover according to aspects of the other illustrative embodiment.

That is, as shown in FIG. 11B, the shaft 22 is formed such that, when the second cover 21 is in the second opened state in which the second cover 21 is opened by the second angle θ2 (e.g., 30 degrees), and the opposing force acts in the vertical direction (i.e., the upper direction in FIG. 11B), the shaft 22 is released from the opening 9E. For example, as shown in FIGS. 11A-11C, the shaft 22 may be formed to be a column shape of which cross section perpendicular to the rotation axis thereof has a width slightly narrower than the opening width of the opening 9E, and both ends in a longer direction are arc-shaped having substantially the same diameter as the bearing 23. With this configuration, in the second state, when the opposing force acts on the second cover 21, the second cover 21 is released from the cover supporting frame 9D.

What is claimed is:

1. A cover movement mechanism, comprising:

a cover configured to rotate;

a base part to which the cover is rotatably attached;

a holding part configured to contact the cover when the cover is in a first opened state in which the cover is rotated to open by a first angle with respect to a closed state of the cover, thereby holding the cover in the first opened state;

two shafts having a common axis and provided to one of the cover and the base part;

two bearings configured to receive the two shafts and provided to other one of the cover and the base part; and a releasing mechanism configured to allow at least one of the two shafts to be released from corresponding one of the two bearings when the cover is in a second opened state in which the cover is rotated to open by a second angle that is smaller than the first angle and an opposing force preventing a rotation of the cover acts on the cover.

2. The cover movement mechanism according to claim 1, wherein the releasing mechanism is configured to release the at least one of the two shafts from the corresponding one of the two bearings when the opposing force, preventing the rotation of the cover from the second opened state to the first opened state, acts on the cover.

3. The cover movement mechanism according to claim 1, wherein the releasing mechanism comprising a tapered truncated part formed on an outer circumferential surface of at least one of the shafts provided on the cover or a tapered truncated part formed on an inner circumferential surface of at least one of the two bearings formed on the cover.

4. The cover movement mechanism according to claim 3, wherein the truncated part is formed at positions corresponding to the first opened state of the cover and the second opened state of the cover.

5. The cover movement mechanism according to claim 3, wherein the two shafts are provided to the cover, the two bearings are provided to the base part, and the truncated part is formed on each of the two shafts.

6. The cover movement mechanism according to claim 5, wherein the truncated part is formed on each of the two shafts in a direction same as a direction of the opposing force.

7. The cover movement mechanism according to claim 6, wherein the cover is configured to cover an upper part of the cover movement mechanism, wherein the two shafts are provided on a front side of the cover movement mechanism and front end parts of the cover, wherein a rear end part of the cover is configured to move toward a front side of the cover movement mechanism as the cover rotates to open, and wherein the truncated part is formed such that the truncated part is directed upward when the opposing force acts on the cover upwardly.

8. The cover movement mechanism according to claim 7, wherein the cover includes a plate-like cover member and side plates arranged on both sides of the plate-like cover member, wherein each of the side plates has a plate spring part which is defined by a slit formed on each of the slide plates, and wherein the two shafts are formed on the plate spring parts, respectively.

9. The cover movement mechanism according to claim 8, wherein each of the plate spring part has a free end separated from the plate spring part by the slit and a fixed part connected to the side plate, and wherein the two shafts are formed on tip end parts of the free ends of the plate spring parts, respectively.

10. The cover movement mechanism according to claim 3, wherein, when the cover is attached to the base part, the outer circumferential surfaces of the two shafts substantially contact inner circumferential surfaces of the two bearings, respectively, except for the truncated parts.

11. The cover movement mechanism according to claim 10, wherein the cover includes a plate-like cover member and side plates provided on both sides of the plate-like cover member, and wherein the two shafts are formed to protrude outwards in a direction of the common axis from the side plates, respectively.

12. The cover movement mechanism according to claim 1, wherein the cover is formed to have a rectangular shape in a plan view, and wherein one end, in a longer side direction, of the cover define an opening part in association with the base part when the cover is closed, an opening width of the opening part being narrowed as the cover is rotated.

13. An image forming apparatus, comprising:

a housing;

a printing unit configured to form an image on a sheet;

a sheet discharging unit configured to discharge the sheet on which the image is printed; and a cover movement mechanism, the cover movement mechanism comprising:

a cover configured to rotate;

a base part to which the cover is rotatably attached;

a holding part configured to contact the cover when the cover is in a first opened state in which the cover is rotated to open by a first angle with respect to a closed state of the cover, thereby holding the cover in the first opened state;

two shafts having a common axis and provided to one of the cover and the base part;

two bearings configured to receive the two shafts and provided to other one of the cover and the base part; and a releasing mechanism configured to allow at least one of the two shafts to be released from corresponding one of the two bearings when the cover is in a second opened state in which the cover is rotated to open by a second angle that is smaller than the first angle and an opposing force preventing a rotation of cover acts on the cover, wherein the cover in the first opened state serves as a printed sheet discharge tray configured to receive the sheet discharged by the sheet discharging unit.

* * * * *